US008621878B2

(12) United States Patent
Flamant et al.

(10) Patent No.: US 8,621,878 B2
(45) Date of Patent: Jan. 7, 2014

(54) CRYOGENIC FLUID INJECTION SYSTEM FOR PROCESSING PRODUCTS IN BULK AND METHOD OF COOLING IMPLEMENTING SAID SYSTEM

(75) Inventors: Herve Flamant, Libourne (FR); Olivier Pouchain, Reze (FR); Jacques Fouche, Verrieres-le-Buisson (FR); Jo Algoet, Wijtschate (BE)

(73) Assignee: L'Air Liquide Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 819 days.

(21) Appl. No.: 12/373,217

(22) PCT Filed: Jun. 28, 2007

(86) PCT No.: PCT/FR2007/051549

§ 371 (c)(1),
(2), (4) Date: Jan. 9, 2009

(87) PCT Pub. No.: WO2008/007000

PCT Pub. Date: Jan. 17, 2008

(65) Prior Publication Data

US 2009/0314010 A1 Dec. 24, 2009

(30) Foreign Application Priority Data

Jul. 10, 2006 (FR) ..... 06 52885

(51) Int. Cl.

| | |
|---|---|
| ***F25D 17/02*** | (2006.01) |
| ***F25D 25/00*** | (2006.01) |
| ***F25C 1/18*** | (2006.01) |
| ***F17C 7/02*** | (2006.01) |

(52) U.S. Cl.
USPC ..... 62/64; 62/62; 62/70; 62/52.1

(58) Field of Classification Search
USPC ..... 62/64, 640, 52.1, 70; 137/511, 59; 138/27
See application file for complete search history.

(56) References Cited

U.S. PATENT DOCUMENTS

| | | | | |
|---|---|---|---|---|
| 1,898,325 | A | 2/1933 | Venn | |
| 3,213,634 | A | 10/1965 | Granata | |
| 3,848,624 | A * | 11/1974 | Banike | 137/242 |

(Continued)

FOREIGN PATENT DOCUMENTS

| | | |
|---|---|---|
| AU | 7 358 981 | 2/1982 |
| DE | 19 621 835 | 12/1997 |
| EP | 0 376 823 | 7/1990 |
| EP | 0 744 578 | 11/1996 |
| FR | 2 211 401 | 7/1974 |
| JP | 1 088 077 | 4/1989 |

OTHER PUBLICATIONS

International Search Report and Written Opinion for PCT/FR2007/051549, mailed Jan. 11, 2008.

*Primary Examiner* — Mohammad M Ali
*Assistant Examiner* — Keith Raymond
(74) *Attorney, Agent, or Firm* — Christopher J. Cronin

(57) ABSTRACT

The injection device according to the invention, intended to be attached to the wall of the bottom of a container containing a product to be cooled in bulk, includes a hollow cylindrical body in which a valve forced by a spring is inserted, a throughchannel appreciably parallel to said valve intended to be fed by pressurized cryogenic fluid, one end of said through-channel being connected to the cryogenic fluid feed system and the opposite end opening into the seat of the valve.

6 Claims, 2 Drawing Sheets

(56) References Cited

U.S. PATENT DOCUMENTS

| | | | | | |
|---|---|---|---|---|---|
| 3,905,555 | A | | 9/1975 | Gateshill et al. | |
| 4,056,745 | A | * | 11/1977 | Eckels | 310/52 |
| 4,476,686 | A | * | 10/1984 | Madsen et al. | 62/63 |
| 4,842,198 | A | * | 6/1989 | Chang | 239/200 |
| 5,018,667 | A | | 5/1991 | Lloyd | |
| 5,299,919 | A | * | 4/1994 | Paul et al. | 417/387 |
| 5,595,065 | A | * | 1/1997 | Boiarski et al. | 62/222 |
| 6,176,437 | B1 | * | 1/2001 | Pedersen | 239/99 |
| 6,233,950 | B1 | * | 5/2001 | Cloarec | 62/70 |

* cited by examiner

CRYOGENIC FLUID INJECTION SYSTEM FOR PROCESSING PRODUCTS IN BULK AND METHOD OF COOLING IMPLEMENTING SAID SYSTEM

CROSS-REFERENCE TO RELATED APPLICATIONS

This application is a §371 of International PCT Application PCT/FR2007/051549, filed Jun. 28, 2007.

BACKGROUND

The present invention relates to a device for injecting a cryogenic fluid into a chamber, under a pressure that is higher than the pressure in the chamber.

It is known to cool the content of a mixer or a kneader by introducing liquid $CO_2$ or liquid nitrogen (LN2) at the base of the bowl of the mixer or kneader. The liquid $CO_2$, introduced under pressure via an injection nozzle, is converted, upon its expansion, in the nozzle, to a solid (dry ice), and to a cold gas. The solid is mixed with the content of the mixer and cools it, but the cold gas also contributes to cooling by passing through the overall mass contained in the bowl.

A known device for implementing this method comprises a plurality of injection devices, disposed in the bottom of the bowl, and fed with liquid $CO_2$ via a set of pipes, this set being provided with a single common control valve.

When the valve is closed, the liquid $CO_2$ present in the pipes downstream of this valve cannot be removed very rapidly by the injection devices, and, when the pressure falls below about 5.18 bar in the pipes, it is converted to dry ice in these pipes, which are thereby clogged. It is therefore impossible to resume the injection as long as this dry ice has not disappeared by being converted to gas by heating.

It is possible to provide for the pipes connecting the valve to the injection devices to be flexible, thereby permitting dismantling, and in consequence, serving to accelerate the restart of the system. However, this dismantling is a relatively lengthy and arduous operation.

The same drawbacks subsist if, instead of a common valve for all the injection devices, a plurality of independent valves are provided, each connected to an injection device by a separate flexible pipe: in this case clogging occurs in the flexible pipe.

It has been found that the clogging occurs when the pressure of the liquid $CO_2$ falls below 14 bar, which occurs fairly frequently when storage containers called "super-insulated" containers are used, such containers often being preferred in order to limit the heat losses.

A device for injecting into a chamber a liquid liable to solidify by expansion is known from document EP-A-376 823.

Patent EP-744 578 describes an injection device that overcomes the problems caused by clogging incidents in normal operating conditions. This device is such that the connection between the shutoff valve and the injection nozzle is calculated so that any slug formed in said connection and said nozzle following a closure of the injection valve can be expelled into the chamber by the pressurized liquid when the injection valve is reopened.

Thus the device does not comprise means for preventing the formation of the slug, but it is possible to expel this slug upon restart, so that a fresh injection can be carried out at any time after the end of a prior injection period. However, it proves that this device can be clogged by the entry of the material to be cooled in the injection device, so that the use of this device is limited to the cooling of a solid product.

A real need therefore exists for a device for injecting cryogenic fluid, a device that does not have the drawbacks encountered with the devices of the prior art and which is suitable for cooling any type of product, regardless of its physical state.

SUMMARY OF THE INVENTION

Thus the present invention relates to an injection device intended to be fixed to the bottom part of a container containing a product to be cooled in bulk, said injection device comprising a hollow cylindrical body in which a valve forced by a spring is inserted, said injection device comprising a through channel substantially parallel to said valve intended to be fed with pressurized cryogenic fluid, one end of said through channel being connected to the cryogenic fluid feed system and the opposite end terminating at the seat of the valve.

The spring is loaded in such a way that the valve cannot slide without being subjected to a cryogenic fluid pressure at least equal to a threshold pressure. Thus, as soon as the cryogenic fluid pressure is lower than a predefined threshold, the pressure required to cause the valve to slide will no longer be reached and the valve seat is repositioned tightly against the support wall.

Thanks to the device according to the invention, it is impossible for the material contained in the chamber to enter the device and create obstructions requiring dismantling and cleaning, regardless of the physical state of this material.

The device according to the invention is therefore equally suitable for cooling a product in liquid, pasty, solid or granular form.

In the context of the present invention, "pasty product" means any product having a viscosity between liquid and solid.

The device can advantageously replace, by overhead cooling, devices of vessels containing liquid or powdery products for which the bottom cooling systems of the prior art were unsuitable.

The cryogenic fluid used is liquid nitrogen or liquid $CO_2$, particularly when the product to be cooled is a food product. However, the device according to the invention can be implemented with any type of cryogenic fluid.

The choice of the spring and its loading obviously depend on the cryogenic fluid that is used. Thus for nitrogen, it must be able to be loaded typically between 0 and 7 bar and for $CO_2$ up to 25 bar.

In order to optimize the operation of the valve, the device may comprise a plurality of through channels of which one end terminates at the seat of the valve. Thus, according to an advantageous embodiment, the device comprises n through channels, where n is between 1 and 20, an even number, their number increasing as the service pressure of the cryogenic fluid decreases, said channels being disposed symmetrically about the longitudinal axis of the valve. According to a particularly advantageous embodiment, two channels are disposed symmetrically about the longitudinal axis of the valve.

The device according to the invention is subjected to very great differences in temperature. In fact, the chamber wall to which the device is fixed is generally at ambient temperature, whereas the opposite part of the device which receives the cryogenic fluid feed is at a temperature of −196° C. Icing of the outer surface of the chamber is therefore inevitable. This may cause the material to be cooled to adhere to the icy wall of the chamber. The icy points become bonding points of the product contained in the chamber. These points expend and ultimately obstruct the valve, preventing any further injection of cryogenic fluid.

To avoid icing, according to one advantageous embodiment, provision is made to place a thermal bridge, that is, to insert a part of insulating material between the element of the device directly connected with the cryogenic fluid inlet and the element of the device placed directly on the vessel wall, the component elements then being dissociable.

The thermal bridge can be prepared from any insulating material, particularly a polymer resin or any other insulating plastic.

According to one particular embodiment, the device according to the invention comprises:

- a bottom element, which, in the operating position, is furthest from the chamber wall, and which is connected to the cryogenic fluid feed system,
- a central element whose lower end bears on the bottom element,
- a valve placed slidingly in a through hole made axially in the central element, the seat of the valve bearing tightly against the upper beveled part of said through hole,
- a thermal bridge surrounding the central element and whereof the lower end bears against the bottom element,
- a wall element surrounding the thermal bridge whereof the lower end bears against the bottom edge of the thermal bridge and whereof the upper end is intended to be fixed to the chamber wall, said bottom element comprising:

- at least one feed channel whereof one end is connected to the feed system and the other end is connected to one end of a through channel present in the central element, said through channel being substantially parallel to the valve axis, its other end terminating at the valve seat,
- a blind central recess intended to accommodate the free end of the valve axis surrounded by a loading spring, said through hole of the central part having a larger diameter at its lower end, so that in the assembled position, the loading spring is maintained against said shoulder in the central larger diameter hole and in the central recess of the bottom element.

Advantageously, the various components are made from steel, preferably from stainless steel, with the exception of the thermal bridge, which is made from an insulating material.

Advantageously, the various components are held together by means of a quick release or screwed or bayonet or similar coupling.

It must be possible to dismantle the inventive device particularly for the loading of the spring forcing the valve, or for a cleaning which is mandatory in the case of food products and which may be necessitated by an abnormal operation or even by accidental pollution.

According to one advantageous embodiment, the device is connected to the cryogenic fluid feed via a flexible fluid pipe. This is designed to allow rapid dismantling. In fact, the flexible pipe does not need to be dismantled for cleaning.

According to a preferred embodiment, the cleaning is further facilitated by maintaining the various components together by means of a mechanical rapid holding system ("quick" coupling).

According to a preferred embodiment, the inventive device being intended for operation under pressure, means are provided so that only authorized personnel can dismantle the device. For this purpose, the components of the device are fixed together by means of pilfer-proof screws and an anti-backlash cable is fixed on the one hand to the flexible hose, and, on the other hand, on either side of the "quick" coupling, to the bottom part of the device and to the top part thereof. The anti-backlash cable can only be removed by a special wrench whose use is reserved exclusively for authorized persons.

The inventive device is fixed tangentially to the previously perforated wall of the chamber. In the case in which the chamber is a mixer, it is advantageous to place the devices at about 45° from the mixing arms in a segment between an angle of 0° (that is, vertical) to 50° with regard to an angle of 90° (that is, horizontal to the mixer arms) so that the cryogenic fluid is injected into the core of the material to be cooled.

Furthermore, contrary to the devices of the prior art, part of the cryogenic fluid is already converted to solid before entering into contact with the mass to be cooled. This is because the cryogenic solid is formed as soon as the fluid strikes the seat of the valve in the space lying between the seat and the support. Owing to the fact that it is the cryogenic solid that enters into contact with the material to be cooled, the cooling efficiency is therefore higher than that obtained with the devices of the prior art.

The product can obviously be in motion in the chamber, thereby favoring heat exchanges and hence the cooling of the content.

According to an advantageous embodiment, the device according to the invention is fixed to the bottom part of the mixing bowl.

BRIEF DESCRIPTION OF THE FIGURES

The invention will now be described in greater detail by means of a practical example, illustrated with the drawings, in which.

DETAILED DESCRIPTION OF THE INVENTION

Figure 1:
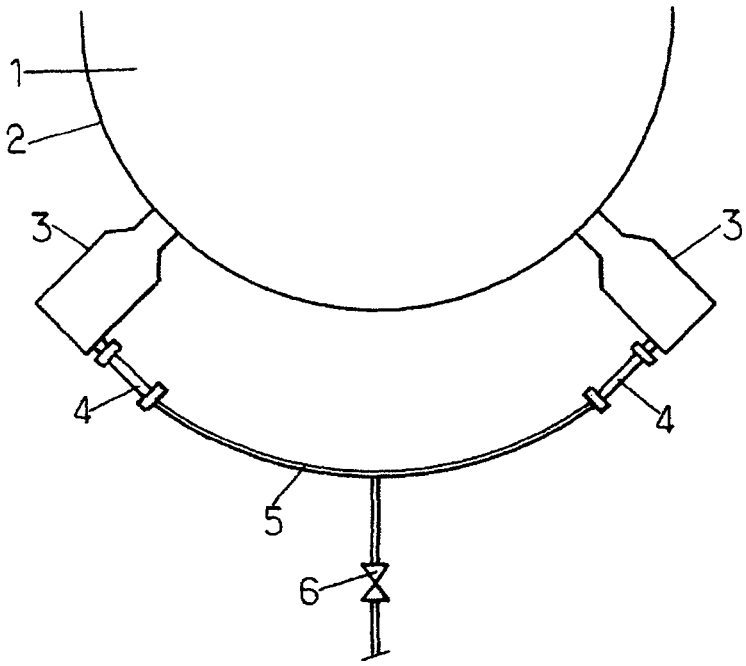
FIG. 1 shows a cross section of an installation comprising a chamber and devices according to the invention.

FIG. 1 shows the bottom part of a chamber 1 on the wall of which two cryogenic fluid injection devices 3 according to the invention are fixed, preferably by welding. The devices 3 are connected by a flexible hose 4 and a thermally insulated pipe 5 to a solenoid valve 6 for the opening and closing of the cryogenic fluid feed.

Figure 2:
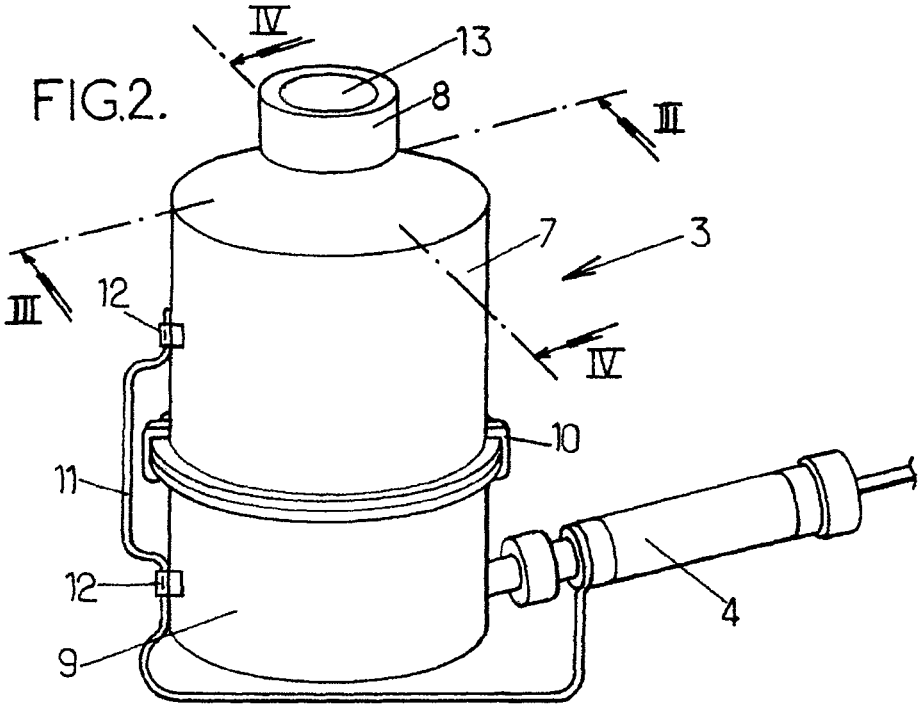
FIG. 2 shows an elevation view of a device according to the invention.

FIG. 2 shows an injection device 3 in greater detail, comprising an upper part 7 whereof the free end 8 is intended to be fixed to the outer wall of a chamber, and a bottom part 9, the two parts being connected by a quick coupling 10. A flexible hose 4 is connected to the bottom part 9 of said device 3. An anti-backlash cable 11 connects the flexible hose 4, the bottom part 9 and the upper part 7. This cable is fixed by means of safety hooks 12 so that only authorized persons can release it, for dismantling for example.

The valve, whereof only the upper face 13 is visible, is housed inside the device 3.

Figure 4:
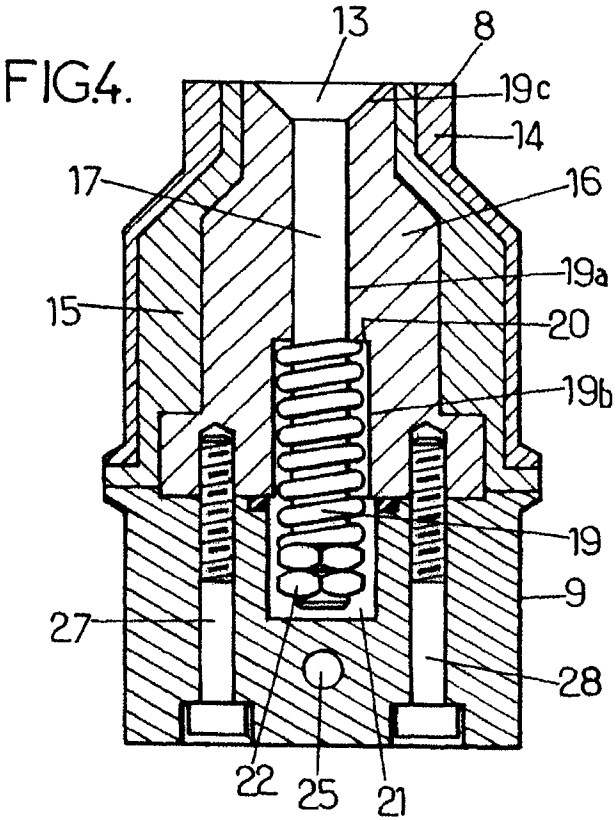
FIG. 4 shows a cross section along IV-IV in FIG. 2.
Figure 3:
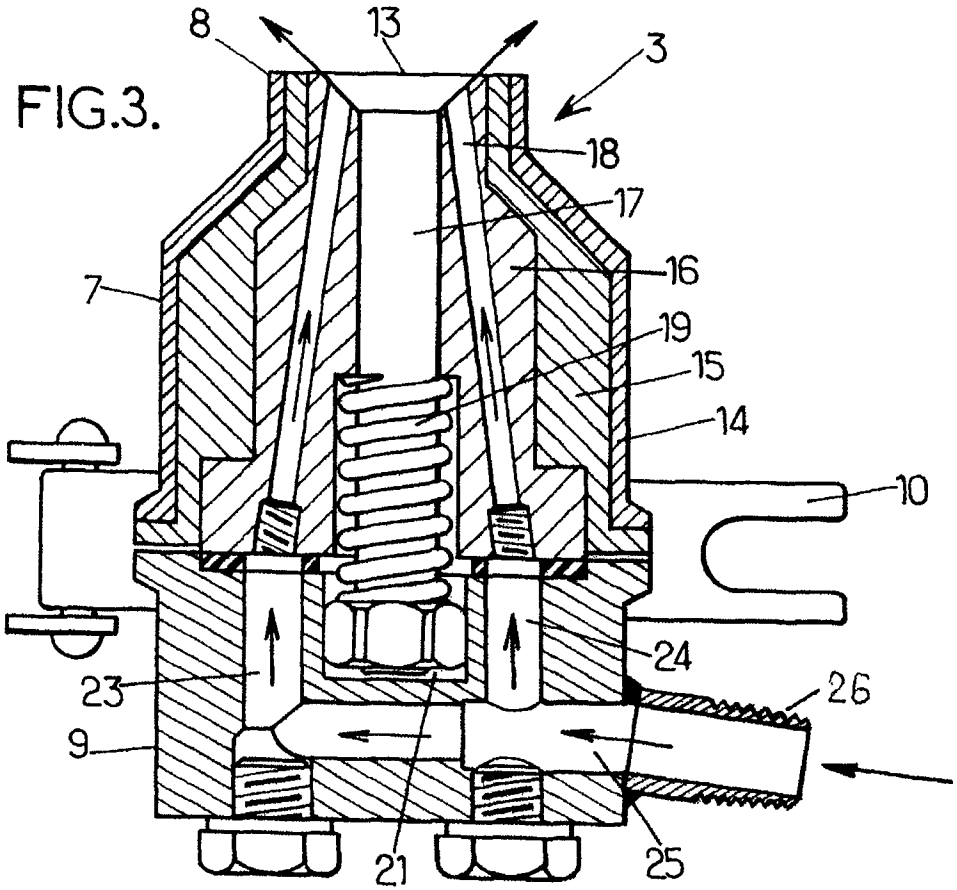
FIG. 3 shows a cross section along III-III in FIG. 2.

As is more clearly observable in FIGS. 3 and 4, the injection device 3 comprises a body consisting of two parts joined together, the bottom part 9 and the upper part 7. The upper part itself consists of three elements, a substantially cylindrical outer wall 14 of stainless steel, whereof one end bears directly against the bottom part 9, and whereof the other end is intended to be fixed to the chamber wall.

Inside this wall 14, a part with a matching shape is placed, called thermal bridge, also hollow, insulating, inside which a third stainless steel element 16 is placed, traversed at its center by the valve 17 and by two through channels 18 opening onto the upper beveled part of the part 16 intended to accommodate the seat 13 of the valve 17.

The central through opening of the part 16 comprises three zones, a central zone 19*a* having a diameter substantially equal to that of the valve, so that the valve can be placed slidingly in this zone, and a bottom zone 19*b* having a larger diameter, so that it can accommodate, around the axis of the valve, the spring 19 forcing said valve. This spring 19 is maintained by the shoulder 20 formed between the zones 19*a* and 19*b*.

At the upper opposite end, the zone 19*c* has a beveled shape, with a larger diameter at its free end, the shape of the bevel being suitable for tightly accommodating the seat of the valve when the valve is forced by the spring.

The bottom part 9 consists of a single stainless steel element, having a generally cylindrical shape. This part comprises a blind central recess 21 which, when the device is mounted, coincides with the opening 19*b* of the upper part. This recess is intended to accommodate the end of the valve maintained by the spring 19 and the spring loading nut 22.

It also comprises, on either side of the blind recess, two vertical channels 23, 24 which, in the assembled position, each terminate at one end at a through channel 18 and at the other end in a perpendicular channel 25 of which one of the ends terminates at the channel 23 and the other is intended to be connected to the cryogenic fluid feed system by means of the coupling 26.

The bottom part 9 is fixed to the central part 16 by screws 27 and 28.

The screw 28 is a removal-proof screw in compliance with the safety standards for pressurized devices.

The parts 14 and 15 are joined to the part 9 by the coupling 10 (shown in FIG. 2).

The coupling 10 is a quick release coupling. It could also be of the screwed or bayonet or similar type.

In operation, the valve 6 is open, and the cryogenic fluid is sent via the pipes 5 and the hose 4 into the device 3, through the channel 25, and then through each of the channels 18. The pressurized fluid then applies a pressure to the seat of the valve, a space is thereby formed between the part 19*c* and the valve seat. The cryogenic solid begins to form in this space by the impact between the fluid and the valve seat, and is forced into the chamber. When it becomes necessary to stop the cryogenic fluid feed, the valve 6 is closed.

It may be observed that the dismantling-reassembly operations of the injection system 3 are very easy. If the coupling 10 is removed, the various constituent parts are separated, thereby allowing their inspection and cleaning.

The invention also relates to the use of an injection device as previously described for cooling a product in bulk.

It also relates to a method for cooling a material in bulk contained in a chamber, whereby a cryogenic fluid is injected into the core of the material to be cooled by means of at least one injection device, preferably m injection devices symmetrically distributed in the bottom part of the chamber, where m is an integer between 2 and 20, preferably an even number.

Advantageously, the chamber is a mixer.

The method is particularly suitable for cooling any type of material regardless of its physical state, particularly for liquid, pasty, solid or powder products.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. An injection device intended to be fixed to a wall of a bottom part of a container containing a product to be cooled in bulk, said injection device comprising:

a bottom element, which, in an operating position, is furthest from a wall of a container containing a product to be cooled in bulk, and which is connectable to a cryogenic fluid feed system, said bottom element comprising:

a feed channel having first and second ends, said first end of said feed channel being connectable to a cryogenic fluid feed system, and a blind central recess;

a central element whose lower end bears on the bottom element, said central element comprising an axially extending through hole and first and second through channels each one of which having first and second ends, each of said first ends of said through channels being beveled, said second end of said feed channel being connected to said second ends of said through channel;

a valve comprising a loading spring tightly biasing a valve seat against said first ends of said through channel, said valve being disposed slidingly in said axially extending through hole, said axially extending through hole of said central element having a larger diameter at a lower end thereof and a smaller diameter at an upper end thereof so that a first end of said loading spring is maintained against a shoulder formed on a bottom face of said upper end of said axially extending through hole, said blind central recess being adapted to accommodate a second end of the loading spring, the second ends of the through channel terminating at the valve seat, said through channels being substantially parallel to the valve axis;

a thermal bridge surrounding the central element, a lower end of said thermal bridge bearing against the bottom element; and a wall element having a lower end surrounding and bearing against a bottom edge of the thermal bridge and an upper end adapted to be fixed to the chamber wall.

2. The injection device of claim 1, comprising a thermal bridge made of insulating material surrounding the first and second through channels.

3. The injection device of claim 1, which is connectable to the cryogenic fluid feed system via a fluid hose.

4. A method for cooling a product in bulk, comprising the steps of:

providing the injection device of claim 1;

providing a container containing a product to be cooled in bulk, said container having a bottom part having a wall, said injection device being connected to said wall to provide cryogenic fluid into said container, said product being in solid, pasty, liquid or powder form;

feeding a cryogenic fluid from a cryogenic fluid feed system to said injection device and into said container.

5. The method of claim 4, wherein two to twenty of the injection device of claim 1 are provided, said plurality of injection devices being distributed along the wall at substantially equal intervals.

6. The method of claim 5, wherein the container is a mixing bowl, said method further comprising the step of mixing the product in the container.

* * * * *